US005427072A

United States Patent [19]

Udo

[11] Patent Number: 5,427,072

[45] Date of Patent: Jun. 27, 1995

[54] METHOD OF AND SYSTEM FOR COMPUTING FUEL INJECTION AMOUNT FOR INTERNAL COMBUSTION ENGINE

[75] Inventor: Hiroshi Udo, Fujisawa, Japan

[73] Assignee: Nissan Motor Co., Ltd., Yokohama, Japan

[21] Appl. No.: 53,568

[22] Filed: Apr. 28, 1993

[30] Foreign Application Priority Data

Apr. 30, 1992 [JP] Japan ..... 4-111674

[51] Int. Cl.[6] ..... F02M 51/00; F02D 41/18; F02D 41/34

[52] U.S. Cl. ..... 123/492; 123/488

[58] Field of Search ..... 123/492, 493, 436, 488

[56] References Cited

U.S. PATENT DOCUMENTS

| | | | |
|---|---|---|---|
| 4,858,136 | 8/1989 | Tanaka et al. | 123/492 |
| 4,922,877 | 5/1990 | Nagaishi | 123/492 |
| 4,949,694 | 8/1990 | Nagaishi et al. | 123/494 |
| 5,031,597 | 7/1991 | Monden | 123/492 |

FOREIGN PATENT DOCUMENTS

| | | |
|---|---|---|
| 60-249651 | 12/1985 | Japan . |
| 63-36038 | 2/1988 | Japan . |
| 63-129139 | 6/1988 | Japan . |
| 1-273856 | 11/1989 | Japan . |
| 1-290939 | 11/1989 | Japan . |
| 2-286850 | 11/1990 | Japan . |

*Primary Examiner*—Tony M. Argenbright
*Assistant Examiner*—Thomas N. Moulis
*Attorney, Agent, or Firm*—Foley & Lardner

[57] ABSTRACT

A fuel injection amount computing unit for an internal combustion engine is disclosed, wherein when an intake air flow Qho as calculated from a throttle valve opening degree and an engine speed is greater than a predetermined value, and when a variation $\Delta Tp_{REAL}$ of a smoothed basic fuel injection amount $Tp_{REAL}$ is negative and a final basic fuel injection amount AvTp including phase adjustment and prefetched correction is greater than a trimmed basic fuel injection amount TrTp ($=Tp_{REAL} \times Ktrm$), a surging smoothing index ND is switched from a value (0; smoothing prohibited) corresponding to the transient state to a value (3; smoothing maximized) corresponding to the fully open state.

4 Claims, 6 Drawing Sheets

METHOD OF AND SYSTEM FOR COMPUTING FUEL INJECTION AMOUNT FOR INTERNAL COMBUSTION ENGINE

BACKGROUND OF THE INVENTION

The present invention relates generally to a fuel injection amount computing unit for an internal combustion engine, and more particularly, to a fuel injection amount computing unit which computes a fuel injection amount in accordance with an intake air flow.

One of previously proposed fuel injection amount computing units for an internal combustion engine is disclosed, for example, in JP-A 290939. This computing unit calculates, from an intake air flow Q measured by an airflow meter which is disposed in an engine suction system and an engine speed N, a basic fuel injection amount $Tp_0=K\cdot Q/M$, wherein N is a constant. In order to avoid an influence of suction surging, the basic fuel injection amount is smoothed by surging smoothing means which determines a degree of smoothing in accordance with engine operating conditions.

Smoothing is carried out according to the following formula, obtaining a smoothed basic fuel injection amount $Tp_{REAL}$. ND is a surging smoothing index for indicating a degree of smoothing; in the stationary state, ND=1 (½ shifted weighted average); in the transient state, ND=0 (1/1 shifted weighted average; smoothing prohibited) and; in the fully open state, ND=3 (⅛ shifted weighted average).

$$Tp_{REAL}=[(2^{ND}-1)Tp_{REAL}+Tp_0]/2^{ND}$$

Additionally, the computing unit comprises phase adjustment means for correcting the basic fuel injection amount so as to correct a time lag produced from a measuring position of an intake air flow by the airflow meter to the cylinder or delay a phase in response to a boost, and a prefetched correction means for correcting the basic fuel injection amount based on a variation of the intake air flow calculated from a throttle valve opening degree and an engine speed so as to correct a measurement lag of the intake air flow in the initial stage of acceleration. The computing unit carries out the following correction, obtaining a final basic fuel injection amount AvTp:

$$AvTp=AvTp\,(1-Fload)+TrTp\cdot Fload+ThsTp$$

In this formula, first and second terms of a right side correspond to the correction to be carried out by the phase adjustment means, TrTp being a trimmed basic fuel injection amount which is obtained by multiplying $Tp_{REAL}$ by a factor Ktrm ($TrTp=Tp_{REAL}\cdot Ktrm$) so as to correct a dispersion proper to a type of the engine, and Fload being a weighted average factor which is set between 0 and 1. A third term of the right side corresponds to a correction to be carried out by the prefetched correction means, TshTp being a prefetched correction amount which is set by a variation of the intake air flow calculated from the throttle valve opening degree and the engine speed.

As to such a known fuel injection amount computing unit for an internal combustion engine, however, there arises a problem in a characteristic upon acceleration. That is, referring to FIG. 6, if switching from the surging smoothing index ND=0 corresponding to the transient state to the surging smoothing index ND=3 corresponding to the fully open state is carried out on a condition of AvTp>TrTp (or $AvTp>Tp_{REAL}$), this condition is established in a part of the preferred correction or at a timing as indicated by reference character A in FIG. 6, so that the surging smoothing index ND is switched to a value for the fully open state from the initial state of the transient state, carrying out needless surging smoothing operation, resulting in a deteriorated transient responsibility.

It is, therefore, an object of the present invention to provide a fuel injection amount computing unit for an internal combustion engine which provides an excellent transient responsibility with needless surging smoothing operation eliminated.

SUMMARY OF THE INVENTION

According to one aspect of the present invention, there is provided in an internal combustion engine, the engine having a cylinder and a throttle valve:

an airflow meter disposed in a suction system of the engine, said airflow meter outputting a signal indicative of an intake air flow;

a throttle sensor disposed in said suction system of the engine, said throttle sensor outputting a signal indicative of an opening degree of the throttle valve;

a crank angle sensor arranged to output a signal from which an engine speed is calculated; and a microcomputer based control unit connected to said airflow meter, said throttle sensor and said crank angle sensor, said control unit computing a fuel injection amount in accordance with said signal indicative of said intake air flow, said control unit comprising:

surging smoothing means for smoothing a parameter for a computation of said fuel injection amount in accordance with a smoothing degree set in response to operating conditions of the engine and decreasing said smoothing degree in a transient state and increasing said smoothing degree in a fully open state at least;

phase adjustment means for correcting said parameter as smoothed so as to correct a time lag produced from a measuring position of said intake air flow of said airflow meter to a position of the cylinder;

prefetched correction means for correcting said parameter as smoothed in accordance with a variation of said intake air flow calculated from said opening degree of the throttle valve and said engine speed;

first determination means for determining whether a variation of said parameter as corrected by said surging smoothing means is positive or negative;

second determination means for determining that said parameter as corrected by said surging smoothing means, said phase adjustment means and said prefetched correction means is greater than said parameter as corrected by said surging smoothing means; and switching restriction means for carrying out a switching of said smoothing degree of said surging smoothing means when said first determination means provide a result that said variation of said parameter as corrected by said surging smoothing means is negative and said second determination means provide a result that said parameter as corrected by said surging smoothing means, said phase adjustment means and said prefetched correction means is greater than said parameter as corrected by said surging smoothing means during a process of passage from said transient state to said fully open state.

According to another aspect of the present invention, there is provided, in a method of operating an internal combustion engine, the engine being provided with a cylinder, an airflow meter for measuring an intake air flow, a throttle sensor for sensing an opening degree of a throttle valve and a crank angle sensor for obtaining an engine speed, the method comprising the steps of:

smoothing a parameter for a computation of a fuel injection amount in accordance with a smoothing degree set in response to operating conditions of the engine and decreasing said smoothing degree in a transient state and increasing said smoothing degree in a fully open state at least;

correcting said parameter as smoothed so as to correct a time lag produced from a measuring position of the intake air flow of the airflow meter to a position of the cylinder;

correcting said parameter as smoothed in accordance with a variation of the intake air flow calculated from the opening degree of the throttle valve and the engine speed;

determining whether a variation of said parameter as corrected at said smoothing step is positive or negative;

determining that said parameter as corrected at said smoothing step and said two correcting steps is greater than said parameter as corrected at said smoothing step; and carrying out a switching of said smoothing degree at said smoothing step when said positive/negative determining step provides a result that said variation of said parameter as corrected at said smoothing step is negative and said greater determining step provides a result that said parameter as corrected at said smoothing step and said two correcting steps is greater than said parameter as corrected at said smoothing step during a process off passage from said transient state to said fully open state.

DETAILED DESCRIPTION OF THE INVENTION

Figure 1:
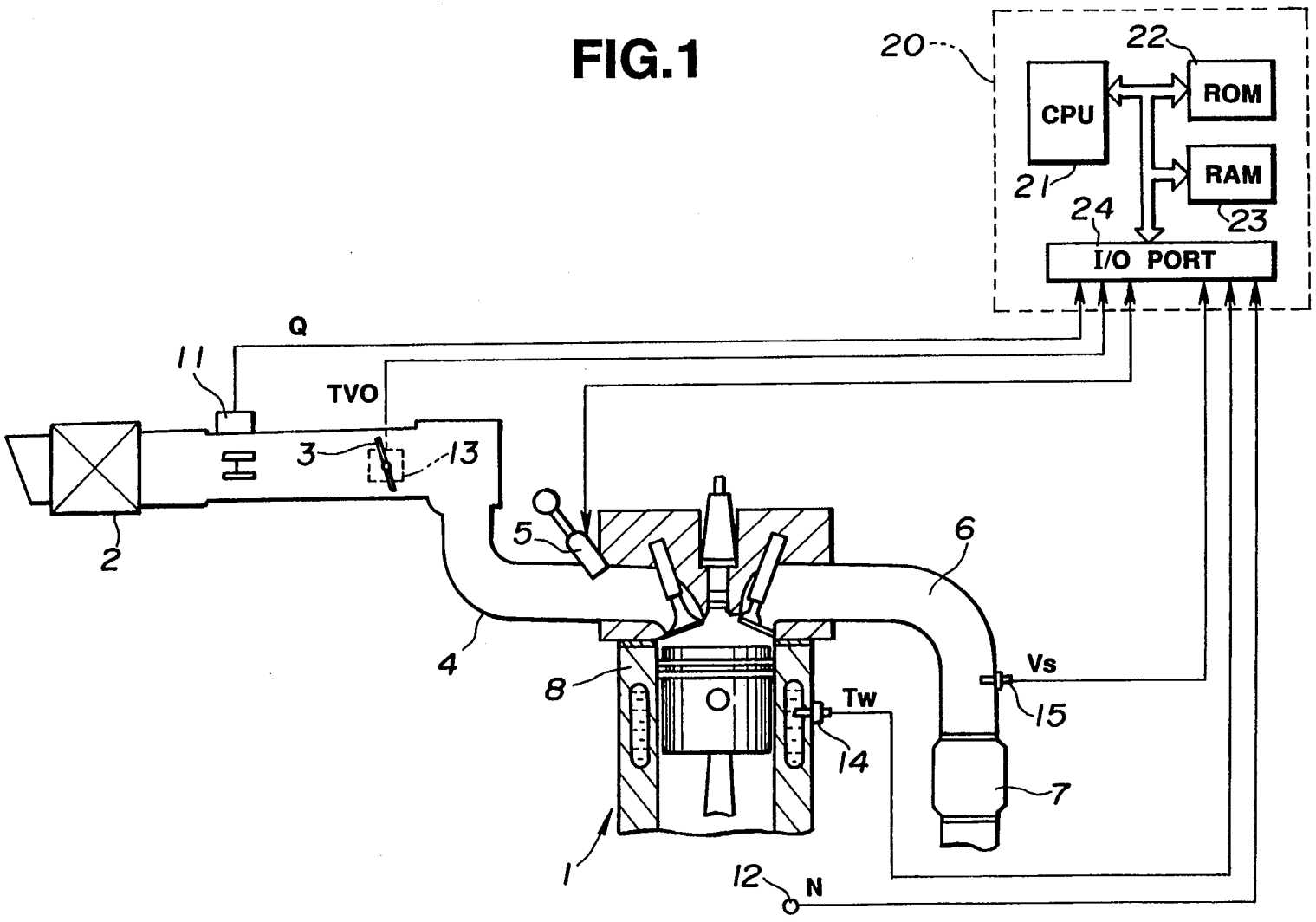
FIG. 1 is a schematic drawing showing a preferred embodiment of the present invention.

Referring first to FIG. 1, air as sucked through an air cleaner 2 is supplied to an internal combustion engine 1 via a suction pipe 4 with the air flow being controlled by a throttle valve 3. Fuel is supplied to the engine 1 from an injector 5 which is disposed in the suction pipe 4 and for each cylinder 8 and carries out injection at a predetermined timing which synchronizes with engine rotation. After combustion within the cylinder 8, exhaust gas is introduced into a catalytic converter 7 via an exhaust pipe 6 for eliminating a harmful constituent within exhaust gas, then discharged in the atmosphere.

Various sensors are disposed for controlling a fuel injection amount of the injector 5:

An airflow meter 11 of the hot wire (or hot film) type is arranged, which outputs a voltage signal corresponding to an intake air flow Q. It is to be noted that the airflow meter 11 may be of the flap type.

A crank angle sensor 12 is arranged, which outputs a pulse signal every predetermined crank angle. An engine speed N can be calculated in accordance with a period off the pulse signal.

A throttle sensor 13 is arranged, which outputs a voltage signal corresponding to an opening degree TVO of the throttle valve 3.

A coolant temperature sensor 14 is arranged, which outputs a voltage signal corresponding to a temperature Tw of a coolant within a water jacket of the engine 1.

An oxygen sensor 15 is arranged for detecting an oxygen concentration in exhaust gas within the exhaust pipe 6 through which an air-fuel ratio is obtained. The oxygen sensor 15 may be of the type having a characteristic that an output voltage Vs undergoes a sudden change at a theoretical air-fuel ratio.

Signals derived from the airflow meter 11, crank angle sensor 12, throttle sensor 13, coolant temperature sensor 14, and oxygen sensor 15 are input to a control unit 20.

The control unit 20 comprises a central processing unit (CPU) 21, a read-only memory (ROM) 22, a random access memory (RAM) 23, and an input/output (I/O) port 24, and it computes a fuel injection amount Ti in accordance with a predetermined program as shown in FIGS. 2–5, and outputs a drive pulse signal having a pulse width corresponding to Ti to the injector 5 at a predetermined timing which synchronizes with engine rotation, making it carry out fuel injection.

Referring next to FIGS. 2–5, the operation of this embodiment will be described.

Figure 2:
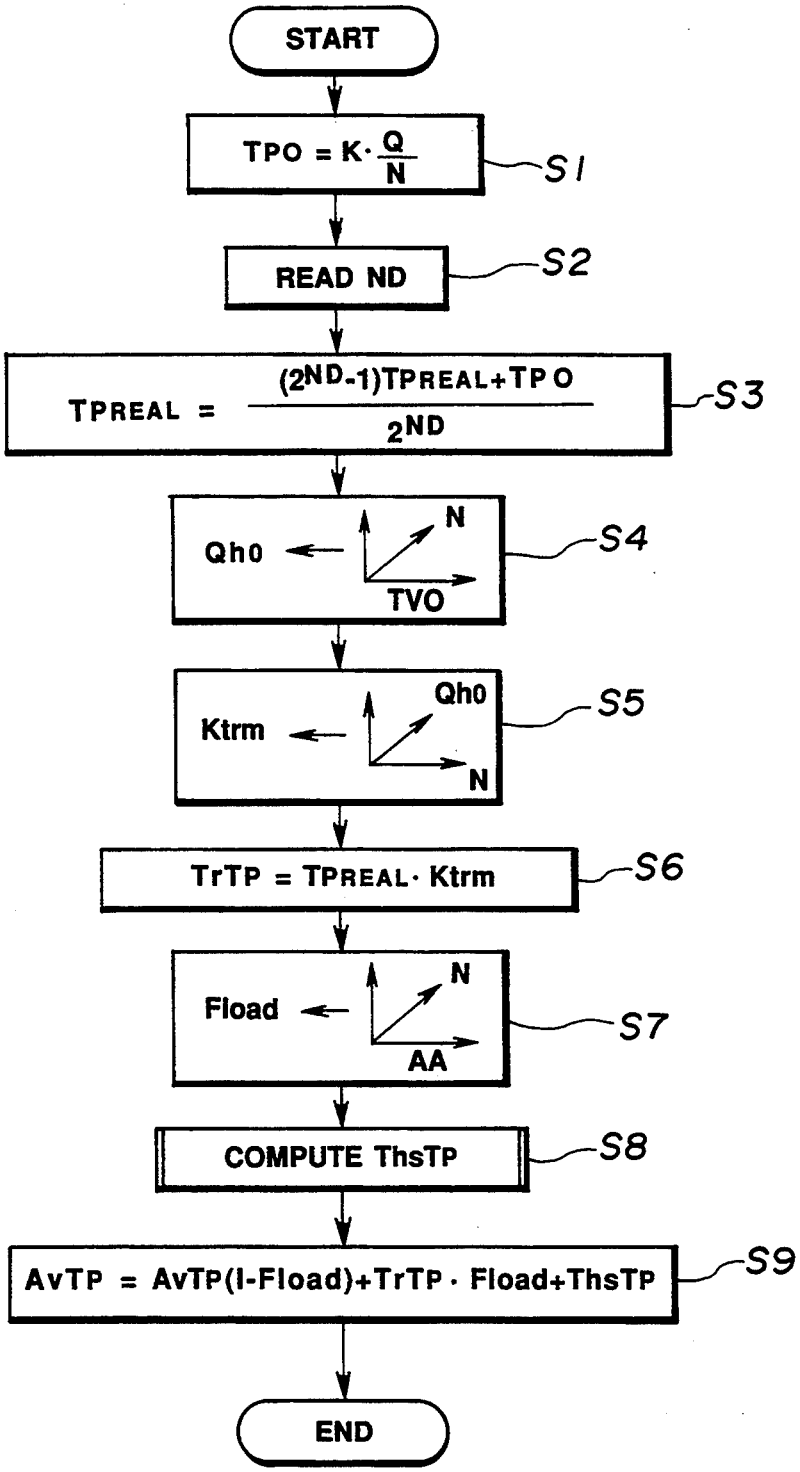
FIG. 2 is a flowchart showing a routine for computing a final basic fuel injection amount AvTp.

Referring to FIG. 2, there is shown a routine for computing a final basic fuel injection amount AvTp which is executed, for example, every 10 ms.

At a step S1, according to the following formula, a basic fuel injection amount $Tp_0$ is computed from an intake air flow Q measured by the airflow meter 11 and an engine speed N calculated based on a signal derived from the crank angle sensor 12:

$$Tp_0 = K \cdot Q/N$$

wherein K is a constant.

Figure 4:
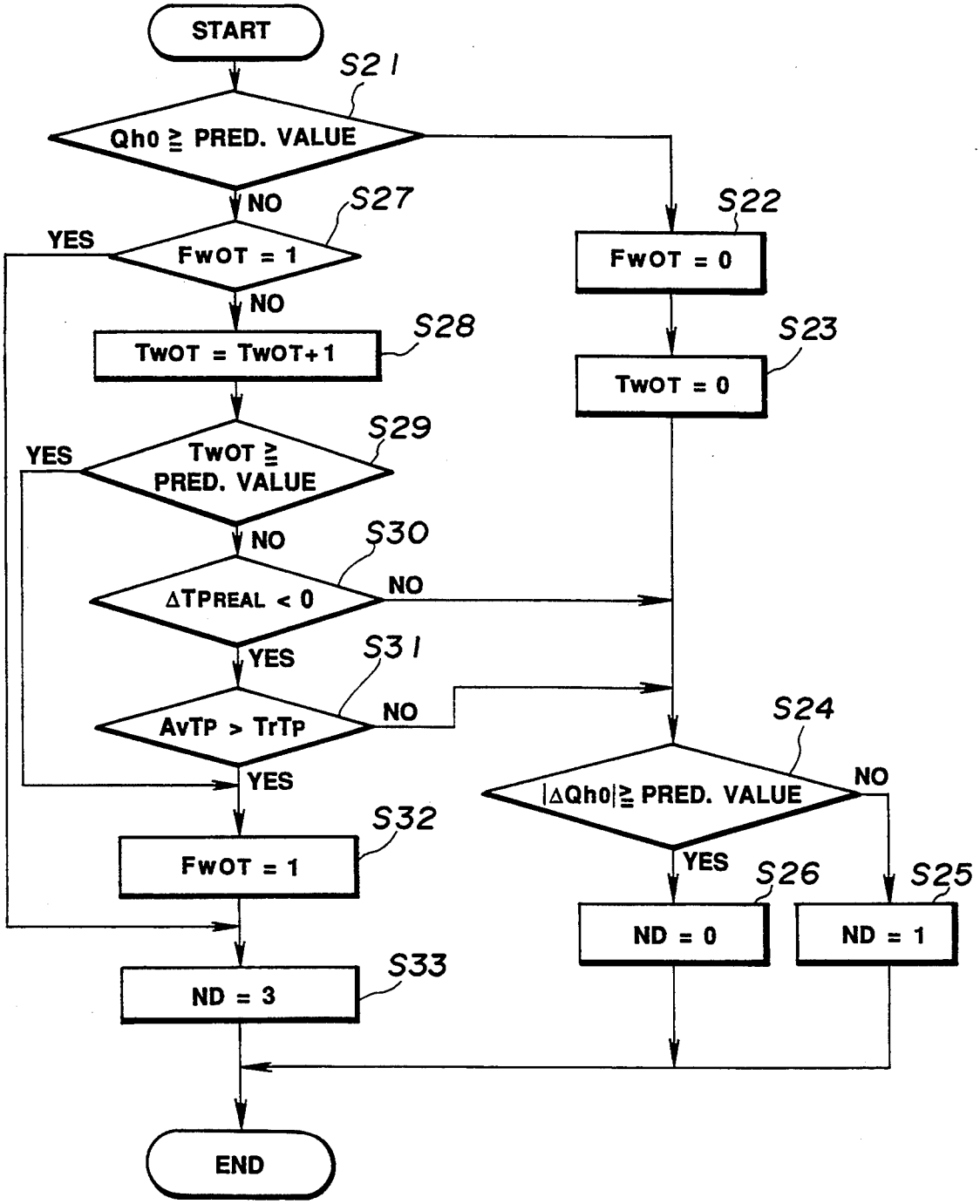
FIG. 4 is a view similar to FIG. 3, showing a routine for setting a surging smoothing index ND.

At a step S2, a surging smoothing index ND is read, which is set by a routine as shown in FIG. 4 which will be described later in detail. Fundamentally, ND) is set to 1 (ND=1) in the stationary state, to 0 (ND=0) in the transient state and to 3 (ND=3) in the fully open state.

At a step S3, according to the following formula, a smoothed basic fuel injection amount $Tp_{REAL}$ is calculated by making a shifted weighted average of the basic fuel injection amount $Tp_0$ based on the surging smoothing index ND:

$$Tp_{REAL} = [(2^{ND}-1)Tp_{REAL} + Tp_0]/2^{ND}$$

Therefore, ½ shifted weighted average is made in the stationary state, and 1/1 shifted weighted average is made in the transient state (smoothing prohibited), and ⅛ shifted weighted average is made in the fully open state, so that an influence of suction surging can be avoided with the transient responsibility ensured. This part corresponds to surging smoothing means.

At a step S4, according to a map, the intake air flow or $\alpha-N$ flow Qho is computed from the throttle valve opening degree TVO and the engine speed N.

At a step S5, according to a map, a trimming factor Ktrm is computed from the engine speed N and the $\alpha-N$ flow Qho. This trimming factor Ktrm is a correction factor For correcting a dispersion proper to a type of the engine such as a mounting position of the airflow meter 11.

At a step S6, as shown in the following formula, a trimmed basic fuel injection amount TrTp is computed by multiplying the smoothed basic fuel injection amount $Tp_{REAL}$ by the trimming factor Ktrm:

$$TrTp = Tp_{REAL} \cdot Ktrm$$

At a step S7, according to a map, a weighted average factor Fload for phase adjustment is computed, as a function of the suction volume, From a passage area AA determined by the throttle valve opening degree TVO and the engine speed N, substantially, from a product NMV of the engine speed and the displacement. It is to be noted that $0 < Fload < 1$.

Figure 3:
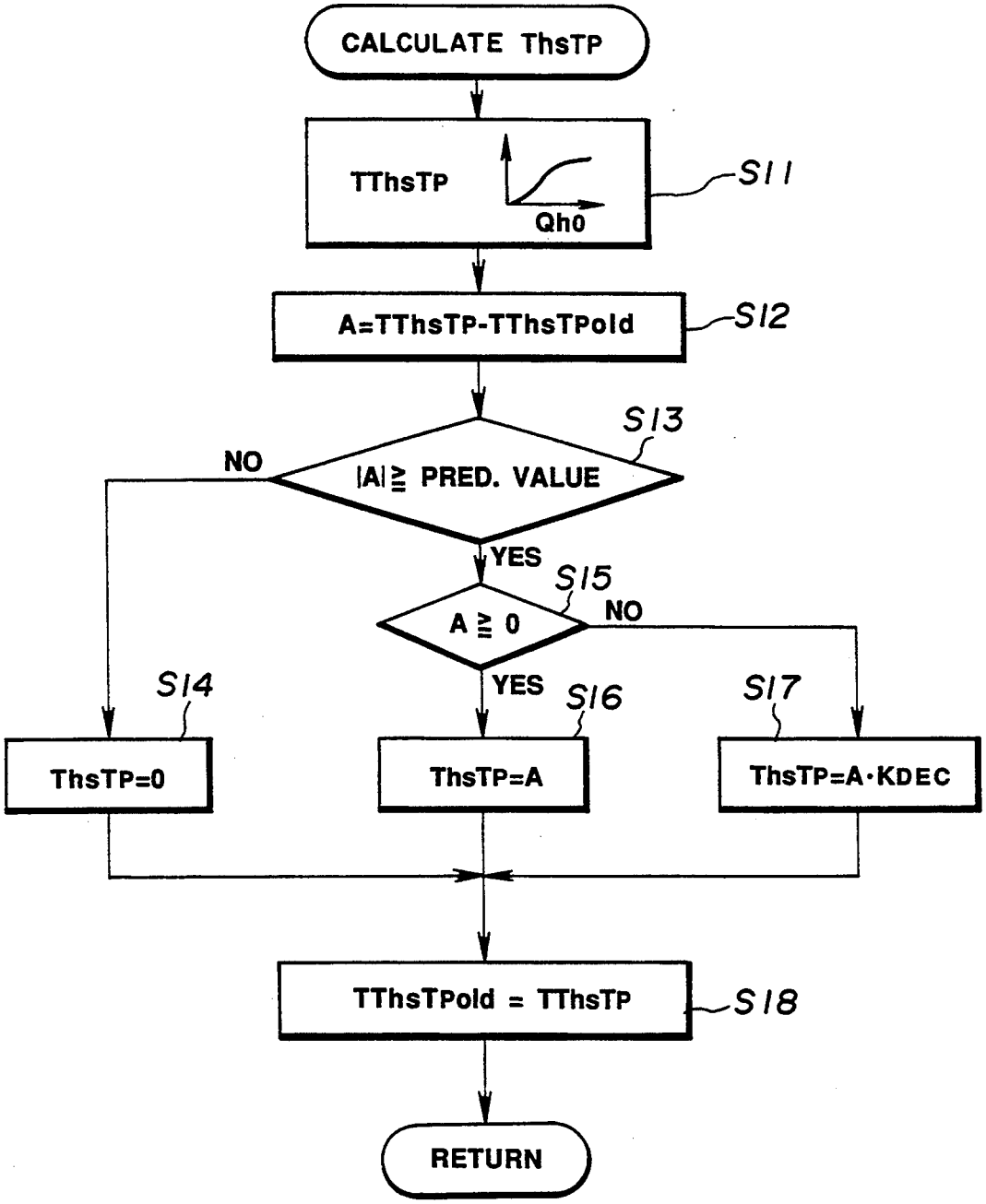
FIG. 3 is a view similar to FIG. 2, showing a subroutine for computing a prefetched correction amount ThsTp.

At a step S8, a prefetched correction amount ThsTp for a prefetched correction is computed by executing a subroutine (steps S11–S18) as shown in FIG. 3.

Referring to FIG. 3, the subroutine will be described.

At a step S11, a prefetched correction amount table value TThsTp is obtained from the $\alpha-N$ flow Qho by table look-up operation.

At a step S12, as shown in the following formula, a variation A per predetermined period of time (10 ms) is computed by subtracting the previous value or value before 10 ms $TThsTp_{old}$ from the prefetched correction amount table value TThsTp:

$$A = TThsTp - TThsTp_{old}$$

At a step S13, an absolute value $|A|$ of the variation A is compared with a predetermined value.

If $|A| <$ predetermined value, it is determined that the engine 1 is in the stationary state or in slow acceleration or deceleration, and not in the transient stage, and the subroutine proceeds to a step S14 for countermeasures against the variation, where the prefetched correction ThsTp is set to 0 ($ThsTp = 0$).

On the other hand, if $|A| \geqq$ predetermined value, it is determined that the engine 1 is in the predetermined transient stage, and the subroutine proceeds to a step S15 where it is determined whether the variation A is positive or negative.

If $A \geqq 0$, it is determined that the engine 1 is in acceleration, and the subroutine proceeds to a step S16 where the prefetched correction value ThsTp is set to the variation A ($ThsTp = A$) at P5.

If $A < 0$, it is determined that the engine 1 is in deceleration, and the subroutine proceeds to a step S17 where the prefetched correction amount ThsTp is set to a value obtained by multiplying the variation A by a predetermined deceleration correction factor $K_{DEC}$ ($ThsTp = A \cdot K_{DEC}$).

After setting the prefetched correction amount ThsTp, the subroutine proceeds to a step S18 where TThsTp is substituted for $TThsTp_{old}$, then it comes to an end.

Returning to FIG. 2, at a step S9, according to the following formula, the final basic fuel injection amount AvTp is computed by carrying out phase adjustment and prefetched correction for the trimmed basic fuel injection amount TrTp:

$$AvTp = AvTp\,(1 - Fload) + TrTp \cdot Fload + ThsTp$$

In this formula, first and second terms of the right side correspond to a correction to be carried out by phase adjustment means, and are parts for calculating a weighted average value of the trimmed basic fuel injection amount TrTp by using the weighted average factor Fload so as to delay the phase in response to a boost for correcting a time lag produced from a measuring position of an intake air flow of the airflow meter 11 to a cylinder, i.e. a first order lag of TrTp.

A third term of the right side corresponds to a correction to be carried out by prefetched correction means, and is a part for adding the prefetched correction amount ThsTp based on a variation of the $\alpha-N$ flow Qho so as to correct a measurement lag of the intake air flow in the initial stage of acceleration.

Referring to FIG. 4, there is shown a routine for setting a surging smoothing index ND, which is executed, for example, every 10 ms.

At a step S21, the $\alpha-N$ flow Qho is compared with a predetermined value.

If Qho < predetermined value, it is determined that the engine 1 fails to be in the fully open state, and the routine proceeds to a step S22 where a fully open determination flag $F_{WOT}$ is set to 0. At a subsequent step S23, a timer $T_{WOT}$ is set to 0, then the routine proceeds to a step S24.

At the step S24, a variation $\Delta Qho = Qho - Qho_{old}$ of the $\alpha-N$ flow Qho is computed ($Qho_{old}$ is a value before 10 ms), and an absolute value $|\Delta Qho|$ thereof is compared with a predetermined value or stationary/transient determination value.

If $|\Delta Qho| <$ predetermined value, it is determined that the engine 1 is in the stationary state, and the routine proceeds to a step S25 where the surging smoothing index ND is set to a value corresponding to the stationary state ($ND = 1$), making surging smoothing operation in accordance with $\frac{1}{2}$ shifted weighted average.

If $|\Delta Qho| \geqq$ predetermined value, it is determined that the engine 1 is in the transient state, and the routine proceeds to a step S26 where the surging smoothing index ND is set to a value corresponding to the transient state ($ND = 0$), prohibiting surging smoothing operation.

At the step S21, if it is determined that $Qho \geqq$ predetermined value, the routine proceeds to a step S27.

At the step S27, it is determined whether or not the fully open determination flag $F_{WOT}$ is already set to 1. If $F_{WOT}$ is still 0, the routine proceeds to a step S28.

At the step S28, the timer $T_{WOT}$ is incremented by 1 ($T_{WOT} = T_{WOT} + 1$), then the routine proceeds to a step S29.

At the step S29, the timer $T_{WOT}$ is compared with a predetermined value. If $T_{WOT} <$ predetermined value (before a lapse of a predetermined period of time), the routine proceeds to a step S30.

A the step S30, a variation $\Delta Tp_{REAL} = Tp_{REAL} - Tp_{REALold}$ of the smoothed basic fuel injection amount $Tp_{REAL}$ is computed ($Tp_{REALold}$ is a value before 10 ms), and $\Delta Tp_{REAL}$ is compared with 0. If $\Delta Tp_{REAL} < 0$, the routine proceeds to a step S31.

At the step S31, the final basic fuel injection amount AvTp is compared with the trimmed basic fuel injection amount TrTp. If $AvTp > TrTp$, the routine proceeds to a step S32.

At the step S32, the fully open determination flag $F_{WOT}$ is set to 1, then the routine proceeds to a step S33.

At the step S33, the surging smoothing index ND is set to a value corresponding to the fully open state (ND=3), making surging smoothing operation in accordance with ⅛ shifted weighted average.

Therefore, unless the following conditions are established: $\Delta Tp_{REAL}<0$ at the step S30 and AvTp>TrTp at the step S31, the routine proceeds to the step S24 where it is determined whether the engine 1 is in the transient state or in the stationary state based on the magnitude of |Qho|, and the surging smoothing index ND is set to prohibit surging smoothing operation or make that one in accordance with ½ shifted weighted average.

In such a way, since, during the process of passage from the transient state to the fully open state, the surging smoothing index ND is switched from a value (0) corresponding to the transient state to a value (3) corresponding to the fully open state after the variation $\Delta Tp_{REAL}$ of the smoothed basic fuel injection amount $Tp_{REAL}$ becomes negative and when the final basic fuel injection amount AvTp becomes greater than the trimmed basic fuel injection amount TrTp (or the smoothed basic fuel injection amount $Tp_{REAL}$), $\Delta Tp_{REAL}$ is positive in the part of the prefetched correction, and therefore the surging smoothing index ND fails to be switched, preventing needless surging smoothing operation.

Figure 6:
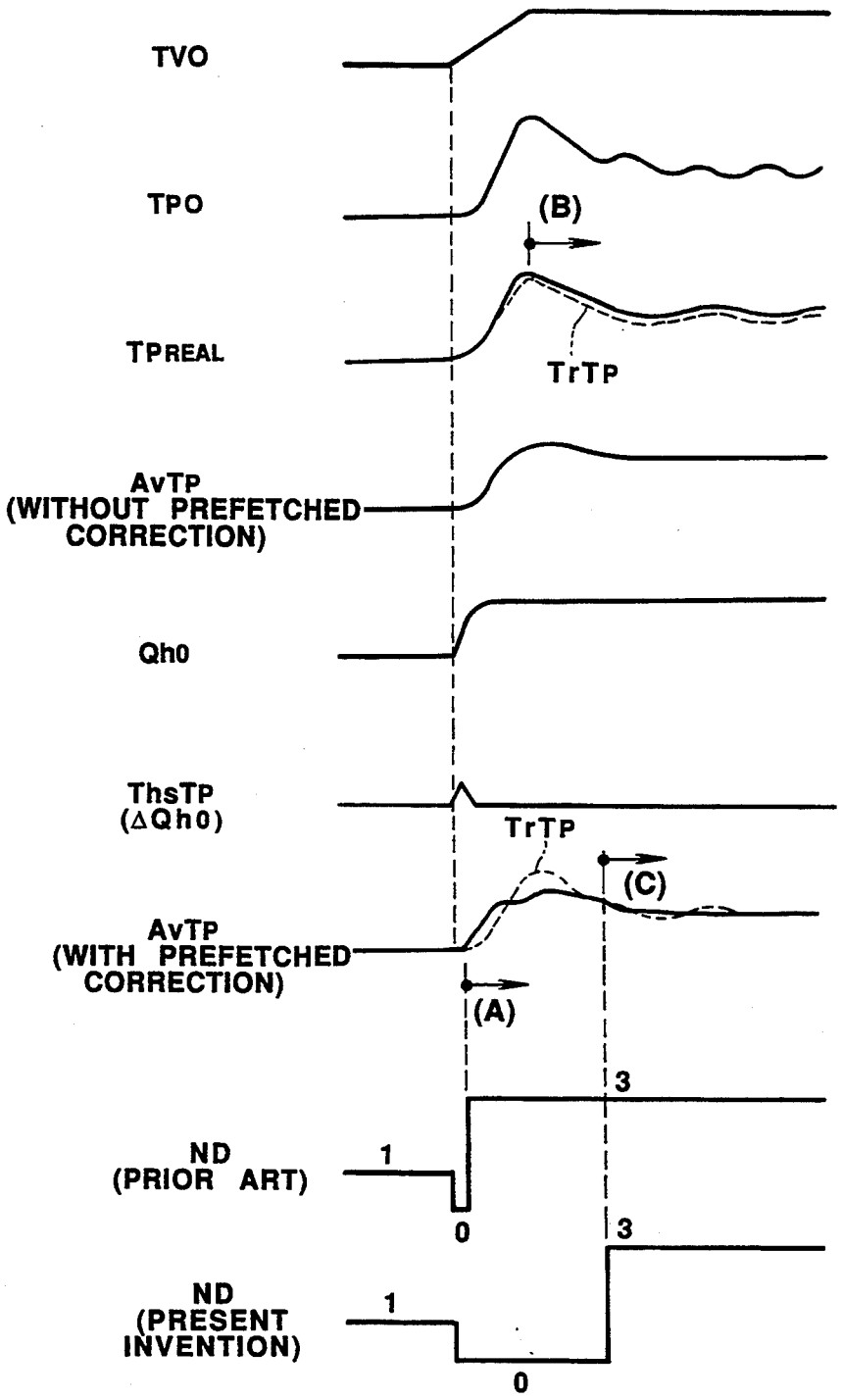
FIG. 6 is a graphical representation showing characteristics upon acceleration.

Specifically, since, in an example as shown in FIG. 6, $\Delta Tp_{REAL}$ becomes smaller than 0 ($\Delta Tp_{REAL}<0$) at a point as indicated by reference character B, then AvTp becomes greater than TrTp (AvTp>TrTp) at a point as indicated by reference character C, the surging smoothing index ND is switched from 0 to 3 from the point C as shown in FIG. G. That is, AvTp becomes greater than TrTp (AvTp>TrTp) at the point A as shown in FIG. 6 due to the prefetched correction, however, $\Delta Tp_{REAL}$ is positive ($\Delta Tp_{REAL}>0$) at this point, so that the surging smoothing index ND fails to be switched from 0 to 3, preventing needless surging smoothing operation.

A part of the step S30 corresponds to first determination means, and a part of the step S31 corresponds to second determination means, and parts leading from the steps S30 and S31 to the step S24 correspond to switching restriction means.

It is to be noted that since the timer $T_{WOT}$ becomes greater than or equal to the predetermined value ($T_{WOT}\geqq$predetermined value) at the step S29 when the state of Qho≧predetermined value continues during a predetermined period of time, the routine proceeds, without passing the steps S30 and S31, to the step S32 where the fully open flag $F_{WOT}$ is set to 1, then at the step S33, the surging smoothing index ND is set to a value corresponding to the fully open state (ND=3), making surging smoothing operation in accordance with ⅛ shifted weighted average.

Figure 5:
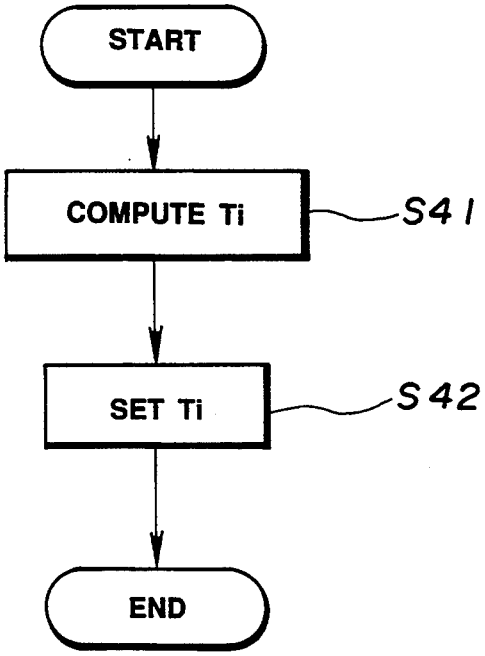
FIG. 5 is a view similar to FIG. 4, showing a routine for computing a fuel injection amount Ti.

Referring to FIG. 5, there is shown a routine for computing the fuel injection amount Ti, which is executed, for example, every 10 ms.

At a step S41, according to the following formula, the fuel injection amount Ti is computed using the final basic fuel injection amount AvTp:

$$Ti=AvTp\cdot Tfbya\cdot Lambda+Ts$$

wherein Tfbya are various correction factors including correction of target air-fuel ratio, increase in coolant temperature, increase in acceleration, etc., and Lambda is an air-fuel feedback correction factor in accordance with a signal derived from the oxygen sensor 15, and Ts is a voltage correction part in accordance with a battery voltage.

At a step S42, the fuel injection amount Ti as computed is set in an output register of the I/O port 24, then the routine comes to an end.

Thus, at a predetermined timing which synchronizes with engine rotation, a drive pulse signal having a pulse width of this Ti is output to the injector 5 which carries out fuel injection.

What is claimed is:

1. In an internal combustion engine, the engine having a cylinder, a throttle valve and an injector:

an airflow meter disposed in a suction system of the engine, said airflow meter outputting a signal indicative of an intake air flow;

a throttle sensor disposed in said suction system of the engine, said throttle sensor outputting a signal indicative of an opening degree of the throttle valve;

a crank angle sensor arranged to output a signal from which an engine speed is calculated; and a microcomputer based control unit connected to said airflow meter, said throttle sensor and said crank angle sensor, said control unit computing a fuel injection amount in accordance with said signal indicative of said intake air flow, said control unit comprising:

surging smoothing means for smoothing a parameter for a computation of said fuel injection amount in accordance with a smoothing degree set in response to operating conditions of the engine and decreasing said smoothing degree in a transient state and increasing said smoothing degree in a fully open state at least;

phase adjustment means for correcting said parameter as smoothed so as to correct a time lag produced from a measuring position of said intake air flow of said airflow meter to a position of the cylinder;

prefetched correction means for correcting said parameter as smoothed in accordance with a variation of said intake air flow calculated from said opening degree of the throttle valve and said engine speed;

first determination means for determining whether a variation of said parameter as corrected by said surging smoothing means is positive or negative;

second determination means for determining that said parameter as corrected by said surging smoothing means, said phase adjustment means and said prefetched correction means is greater than said parameter as corrected by said surging smoothing means;

switching restriction means for carrying out a switching of said smoothing degree of said surging smoothing means when said first determination means provide a result that said variation of said parameter as corrected by said surging smoothing means is negative and said second determination means provide a result that said parameter as corrected by said surging smoothing means, said phase adjustment means and said prefetched correction means is greater than said parameter as corrected by said surging smoothing means during a process of passage from said transient state to said fully open state; and injection control means for controlling a fuel injection of the injector into the cylinder.

2. A system as claimed in claim 1, wherein said parameter includes said intake air flow.

3. A method of operating an internal combustion engine, the engine being provided with a cylinder, an injector, an airflow meter for measuring an intake air flow, a throttle sensor for sensing an opening degree of a throttle valve and a crank angle sensor for obtaining an engine speed, the method comprising the steps of:

smoothing a parameter for a computation of a fuel injection amount in accordance with a smoothing degree set in response to operating conditions of the engine and decreasing said smoothing degree in a transient state and increasing said smoothing degree in a fully open state at least;

correcting said parameter as smoothed so as to correct a time lag produced from a measuring position of the intake air flow of the airflow meter to a position of the cylinder;

correcting said parameter as smoothed in accordance with a variation of the intake air flow calculated from the opening degree of the throttle valve and the engine speed;

determining whether a variation of said parameter as corrected at said smoothing step is positive or negative;

determining that said parameter as corrected at said smoothing step and said two correcting steps is greater than said parameter as corrected at said smoothing step;

carrying out a switching of said smoothing degree at said smoothing step when said positive/negative determining step provides a result that said variation of said parameter as corrected at said smoothing step is negative and said greater determining step provides a result that said parameter as corrected at said smoothing step and said two correcting steps is greater than said parameter as corrected at said smoothing step during a process of passage from said transient state to said fully open state; and controlling a fuel injection of the injector into the cylinder.

4. A method as claimed in claim 8, wherein said parameter includes said intake air flow.

* * * * *